United States Patent [19]

Roth

[11] 4,176,760

[45] Dec. 4, 1979

[54] EASY OPENING CONTAINER UNIT HAVING A DOMED END PANEL

[75] Inventor: Donald J. Roth, Chicago Heights, Ill.

[73] Assignee: The Continental Group, Inc., New York, N.Y.

[21] Appl. No.: 967,763

[22] Filed: Dec. 8, 1978

[51] Int. Cl.[2] ..... B65D 41/00

[52] U.S. Cl. ..... 220/359; 220/260; 220/270; 229/7 R

[58] Field of Search ..... 220/260, 269, 270, 359; 224/7 R; 222/541

[56] References Cited

U.S. PATENT DOCUMENTS

| | | | |
|---|---|---|---|
| 3,908,857 | 9/1975 | Chiappe | 220/359 |
| 3,990,603 | 11/1976 | Brochman | 220/260 |
| 4,140,241 | 2/1979 | Erlandson | 220/359 |

*Primary Examiner*—George T. Hall
*Attorney, Agent, or Firm*—Charles E. Brown

[57] ABSTRACT

An easy opening container wherein the top end of the container is of a domed configuration and is provided with both a filling opening and a dispensing opening arrangement. The dispensing opening arrangement is closed prior to filling by a pull tape which has a peelable bond with the domed end. The filling opening is located generally centrally of the pull tape and is centered relative to the domed end and is relatively small, but of a size through which the container may be filled with the use of specialized filling equipment. The filling opening is preferably closed by a blind rivet and the container is preferably formed of two cups having their open ends joined in opposing relation.

9 Claims, 4 Drawing Figures

FIG.1
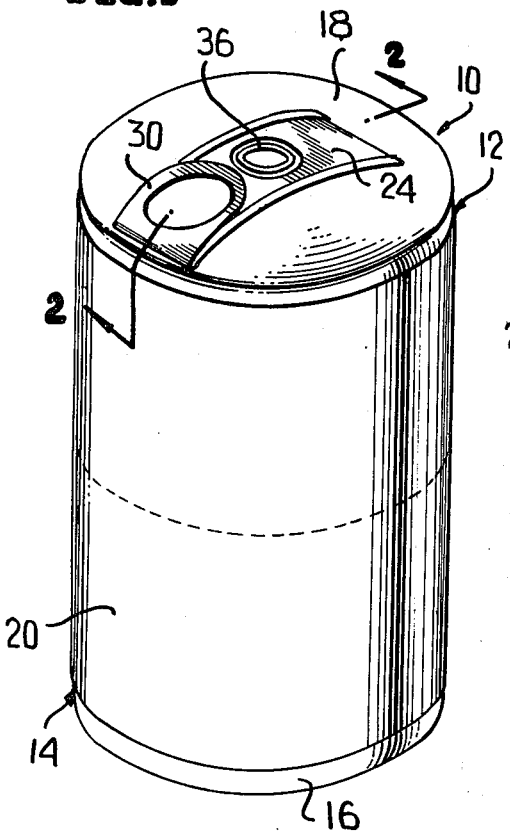
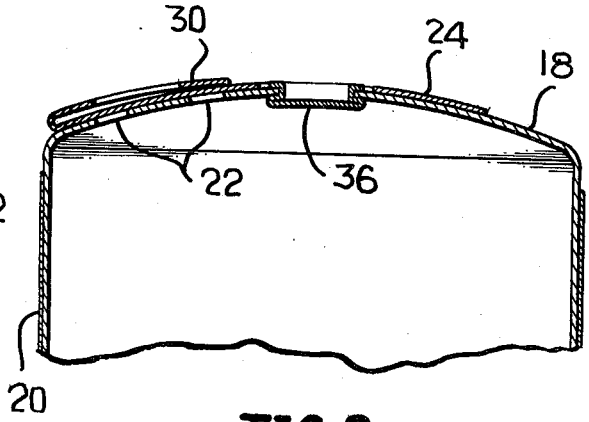
FIG.2
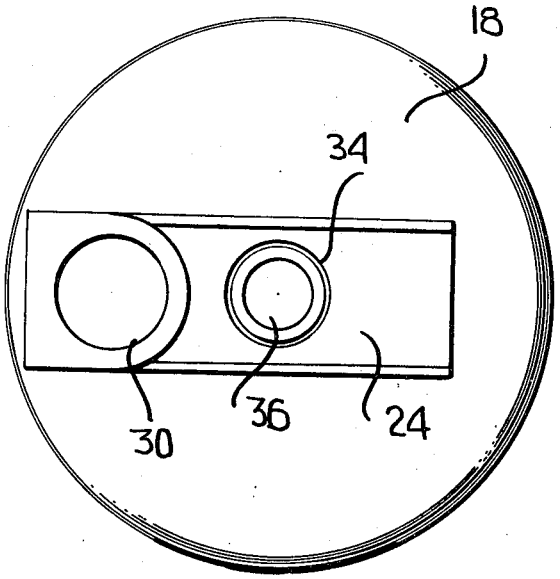
FIG.3
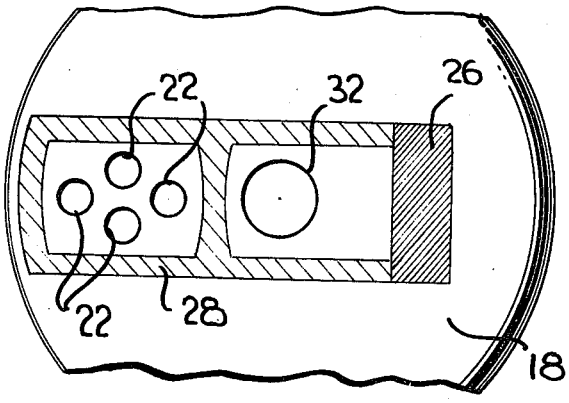
FIG.4

EASY OPENING CONTAINER UNIT HAVING A DOMED END PANEL

This invention relates in general to new and useful improvements in containers, and more particularly to a container having a domed top end, which top end is provided with an easy opening feature.

The customary easy opening container is provided with an end panel which is normally recessed within the double seam and is substantially flat. Limited doming of such end panel may occur with the result that the easy opening device carried thereby may be unduly projected upwardly.

It is well known in the container field that if a container is provided in advance with a domed end, the container is of a more rigid construction and flexing of the end does not occur when the container is internally pressurized.

In accordance with this invention, it is proposed to form the container with a domed end. This end is preferably an integral portion of a container body, but under certain circumstances could be a separately formed element. The domed end is provided with an easy opening feature which is simply in the form of an opening or openings in the end covered by a pull tape. The pull tape is bonded to the surface of the domed end and overlies the opening or openings formed therein. Because the tape of the pull tape is readily foldable, it may closely overlie the domed end and permit packaging of such containers without the pull tape interfering with the packaging and/or stacking of the containers.

It is to be understood that it is desirable to provide the packer with a container which requires no closing in the conventional manner after the container has been filled. In recent years there has been developed a filler which will fill through a relatively small opening. Thus, in accordance with this invention the domed end, generally in alignment with the pull tape, may be provided with a filling opening which, after the filling has been completed, may be readily closed by the insertion of a plug. The plug may simply be in the form of an upset blind rivet. The plug may extend through the pull tape without in any way interfering with the opening operation.

Beneficially, the container may be in the form of two cup-shaped members which have their open ends joined together in sealed relation.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a perspective view of a container formed in accordance with this invention.

FIG. 2 is an enlarged fragmentary vertical sectional view taken generally along the line 2—2 of FIG. 1, and shows the general cross section of the domed end of the container and the details of the easy opening closure thereof.

FIG. 3 is an enlarged fragmentary plan view of the container of FIG. 1, and shows more specifically the details of the top end thereof.

FIG. 4 is a top plan view similar to FIG. 3, but with the pull tape and the plug for the filling opening removed, the pattern of adhesive between the pull tape and the domed end being clearly illustrated.

Referring now to the drawings in detail, it will be seen that there is illustrated in FIG. 1 a container formed in accordance with this invention, the container being generally identified by the numeral 10. In the preferred embodiment of the container, the container is primarily of a two-piece construction and includes an upper half 12 and a lower half 14. Each of the halves 12 and 14 is generally cup shaped in configuration and is preferably of the drawn and wall ironed type. Each container half has a domed end with the bottom half 14 having a domed end 16 which, although it is not illustrated, may include a projection arrangement which provides for a stable supporting of the container 10.

The container half 12 has a domed end 18 which is for all practical purposes a smoothly curved construction as is best shown in FIGS. 1 and 2. The domed ends 16 and 18 eliminate the usual deflection of the ends of a container when internally pressurized, and thus the container 10 is particularly adapted for use in the packaging of carbonated beverages and the like. While the container size may vary, the construction of the container is one which may conveniently be of the conventional one drink type, although it may feasibly be of a much larger size.

It is also to be noted that the body portion of the container may be provided with any suitable type of label 20. The label 20, in addition to identifying the product, will also mask the joint between the two container halves 12, 14. The manner in which the container halves are joined together does not form a part of this invention, although most conveniently the container halves may be aligned in telescoping relation and a suitable bond formed therebetween.

A principal feature of this invention is providing the domed end 18 with an easy opening feature. Accordingly, a suitable dispensing and venting opening arrangement 22 is provided in radially offset relation to the center of the end 18. The opening arrangement is best shown in FIG. 4, and may be varied. The opening arrangement 22 is sealed closed by means of a pull tape 24 which is bonded to the upper surface of the end 18. The construction of the pull tape 24 may vary, but conventionally it is of an aluminum foil-plastic film laminate with the plastic film being bonded to the surface of the domed end 18.

As is clearly shown in FIG. 4, one end of the pull tape 24 terminates in overlying relation to the domed end 18, and this end is permanently secured to the domed end by a permanent adhesive bond 26. The pull tape 24 is further secured to the domed end 18 by a peelable adhesive bond 28 which extends at least about the opening arrangement 22.

In order to facilitate the peeling of the pull tape 24 along the peelable bond 28, the opposite end of the pull tape 24 is free from the domed end 18 and is in the form of a pull ring 30. The portion of the pull tape 24 which forms the pull ring 30 is reversely folded over the underlying portion of the pull tape 24 and is readily folded to a generally upstanding position where one's finger may be inserted into the pull ring and the necessary pulling force applied to the pull tape.

A particular feature of the container 10 is that essentially the construction thereof is complete when it is shipped to the packer. The domed end 18 is provided with a centrally located filling opening 32. The filling opening 32 is relatively small, no more than ½ inch in diameter, and is located generally centrally of the pull tape 24. A clearance opening 34 is formed in the pull tape 24.

It is to be understood that since the filling opening 32 is centrally located, no orientation of the container is required during the filling operation. After the container has been filled, closing of the filled container is effected by the insertion of a plug 36 into the filling opening 32. As is best illustrated in FIG. 2, the plug 36 is preferably in the form of a blind rivet which may be easily and automatically applied. Thus the closing of the filled container 10 may be readily and automatically accomplished while at the same time the filled container may be readily conveyed from the filling machine to the closing machine without the usual danger of spillage.

Although only a preferred embodiment of the easy opening container has been specifically illustrated and described herein, it is to be understood that minor variations may be made in the container construction without departing from the spirit and scope of the invention as defined by the appended claims.

I claim:

1. An easy opening container unit comprising a domed end panel having an area of maximum projection, permanently formed dispensing opening means in said domed end panel, and a displaceable pull tape temporarily sealing said dispensing opening means, said pull tape extending beyond said dispensing opening means and over and byond said area of maximum projection.

2. The container unit of claim 1 wherein said pull tape has a permanent bond with said domed end panel at the end of said pull tape remote from said dispensing opening means, and a peelable bond between other portions of said pull tape and said domed end panel.

3. The container unit of claim 1 wherein there is a preformed filling opening through said area of maximum projection.

4. The container unit of claim 1 wherein there is a preformed filling opening through said area of maximum projection, and a permanent plug closing said filling opening.

5. The container unit of claim 3 wherein said pull tape has an opening therethrough aligned with and of a greater size than said filling opening.

6. The container unit of claim 5 wherein said pull tape has a free end portion in the form of a pull ring overlying said dispensing opening means and spaced from said filling opening.

7. The container unit of claim 1 wherein said domed end is a top end and is integrally formed with a container body portion.

8. The container unit of claim 7 wherein said container is formed of two cup-shaped members with one of said cup-shaped members forming said domed end and said container body portion.

9. The container of claim 8 wherein the other of said cup-shaped members includes a container body portion and a domed bottom end having stabilizing feet means.

* * * * *